US005477048A

United States Patent [19]

Nakagawa et al.

[11] Patent Number: 5,477,048

[45] Date of Patent: Dec. 19, 1995

[54] INDUCTIVELY COUPLED PLASMA MASS SPECTROMETER

[75] Inventors: Yoshitomo Nakagawa; Tetsumasa Ito; Toru Eto, all of Tokyo, Japan

[73] Assignee: Seiko Instruments Inc., Tokyo, Japan

[21] Appl. No.: 118,820

[22] Filed: Sep. 10, 1993

[30] Foreign Application Priority Data

Sep. 10, 1992 [JP] Japan ..... 4-242084

[51] Int. Cl.[6] ..... H01J 49/36

[52] U.S. Cl. ..... 250/288; 250/281

[58] Field of Search ..... 250/288, 288 A, 250/281, 282; 315/111.11, 111.21, 111.91; 219/121.43, 121.51, 121.55

[56] References Cited

U.S. PATENT DOCUMENTS

| | | | |
|---|---|---|---|
| 4,926,021 | 5/1990 | Streusand et al. | 250/288 |
| 4,963,735 | 10/1990 | Okamoto et al. | 250/288 |
| 5,308,977 | 5/1994 | Oishi et al. | 250/288 |

*Primary Examiner*—Jack I. Berman
*Assistant Examiner*—Kiet T. Nguyen
*Attorney, Agent, or Firm*—Loeb & Loeb

[57] ABSTRACT

An inductively coupled mass spectrometer for detecting impurities present in infinitesimal concentrations in a sample. The basic spectrometer structure includes: a nebulizer connected to receive a solution of the sample and a gas for causing the nebulizer to produce a spray in the form of a mist composed of droplets of the sample solution; a spray chamber disposed for receiving the spray and classifying the droplets in the spray; a plasma torch operative for conducting a stream composed of the sample solution and at least one gas; a high frequency power source and a work coil coupled to the plasma torch for supplying energy to generate and maintain a plasma which ionizes the sample solution in the stream; and a mass detector disposed for receiving the ionized sample solution from the plasma torch and operative for detecting impurities in the ionized sample solution. The spray chamber further receives an additional flow of argon gas which acts to suppress the generation of molecular ions in the plasma, so that the analytical performance for detecting impurities, such as Fe or K or the like, is improved.

7 Claims, 3 Drawing Sheets

INDUCTIVELY COUPLED PLASMA MASS SPECTROMETER

BACKGROUND OF THE INVENTION

This invention relates to an inductively coupled plasma mass spectrometer (hereinafter referred to as ICP-MS) that makes it possible to perform identification and measurement of infinitesimal impurity quantities in a sample solution.

The prior art will be described with reference to FIG. 2 which shows a sample introduction portion of an ICP-MS. In FIG. 2, numeral 1 is a sample solution, numeral 2 is a capillary tube, numeral 3 is a nebulizer, or sprayer for creating a fine spray, numeral 4 is an adapter, numeral 5 is a spray chamber, numeral 6 is a drain receptacle, numeral 7 is a plasma torch, numeral 8 is a work coil, numeral 9 is a gas flow controller, numeral 10 is a high frequency power source, numeral 11 is a plasma and numeral 12 is a mass detector.

The sample solution 1 to be analyzed is introduced into the nebulizer 3 through the thin tube-shaped capillary tube 2. At the center of the nebulizer 3, there exists a thin tube which is connected to the capillary tube 2. In nebulizer 3, a gas (hereinafter called nebulizer gas) is caused to flow around the thin tube from the gas flow controller 9. When the nebulizer gas flows through the nebulizer 3, the sample solution 1 is sprayed in the form of a mist into chamber 5 via the top end of chamber 5. Nebulizer 3 has an outlet end which faces into chamber 5 and is provided with an outlet nozzle which forms the sample solution spray. This nebulizer 3 is called a coaxial type nebulizer, but so-called cross-flow type nebulizers also exist. The output end of the nebulizer 3 is connected to the spray chamber 5 by way of the adapter 4. Thus, the sample solution 1 is sprayed into the spray chamber 5. The spray chamber 5 introduces particles having diameters in a specific limited portion of this range. The mist sprayed into spray chamber 5 consists of sample solution particles having a range of diameters to the plasma torch 7 together with the nebulizer gas (this process is called classification). The other mist particles are discharged to the drain 6.

The plasma torch 7 has a triple tube structure, i.e., three tubes nested within one another. The center tube of the plasma torch 7 is connected to the spray chamber 5, and a plasma gas and an assist gas are supplied respectively to the outer tube and the middle tube from the Gas flow controller 9. The plasma gas and assist gas are usually argon.

The work coil 8 is would around the output end of plasma torch 7 so that high frequency power is supplied from high frequency power source 10. The high frequency power is usually supplied at a power level of between 0.8 and 2.0 Kw. When high frequency power is supplied to the work coil 8, and gas flows through plasma torch 7, the plasma 11 is generated and maintained because the gas is inductively coupled with an alternating magnetic field near the work coil 8. The sample solution 1 in the form of a mist introduced into the plasma torch 7 along its axis is ionized in the plasma 11. The ionized sample solution is then introduced into mass detector 12.

The mass detector 12 functions to separate the introduced ions according to mass and to detect the separated ions. Infinitesimal impurity amounts in the sample solution 1 are identified from the detected mass of ions and measured by the detected mass count of the ions.

The structure of such an ICP-MS is disclosed in, for example "The base and application of the ICP Atomic Emission Spectrometer" by Haraguchi, published by Kodansha Scientific.

In the prior art, the gas (argon) and elements of the sample solution, which constitute the plasma, are combined with each other and become molecular ions. The molecular ions are, for example, ArO ions (mass number is 56), or ArH ions (mass number is 39), etc. Therefore, the analytical performance for impurity elements, for example 56Fe, 39K, that have the same mass number as the molecular ions, is decreased a great deal by the influence of interference.

SUMMARY OF THE INVENTION

It is an object of this invention to improve the analytical performance for such element as Fe or K, by suppression of the molecular ion generation which decreases the analytical performance in prior art spectrometers.

The above and other objects are achieved, according to the present invention, by an inductively coupled mass spectrometer for detecting impurities present in infinitesimal concentrations in a sample, the spectrometer comprising:

- a nebulizer connected to receive a solution of the sample;
- a first gas flow controller connected to deliver a gas at a controlled flow rate to the nebulizer for causing the nebulizer to produce a spray in the form of a mist composed of droplets of the sample solution;
- a spray chamber disposed for receiving the spray and classifying the droplets in the spray;
- a plasma torch composed of three tubes, including an outer tube, a middle tube nested within the outer tube and a center tube nested within the middle tube, the center tube being connected to said spray chamber to receive classified spray droplets from the spray chamber, and the outer tube and middle tube being connected to each receive a gas, the torch being operative for conducting a stream composed of the sample solution received by the inner tube and the gas received by each of the middle tube and the outer tube;
- a high frequency power source and a work coil coupled to the plasma torch for supplying energy to generate and maintain a plasma which ionizes the sample solution in the stream;
- a mass detector disposed for receiving the ionized sample solution from the plasma torch and operative for detecting impurities in the ionized sample solution; and
- gas introducing means, such as a second gas flow controller, for delivering a flow of argon gas into the spray chamber.

By this invention, the generation of molecular ions is suppressed, and the analytical performance for Fe or K or the like which is not detected precisely by the prior art, is improved.

In the inductively coupled plasma mass spectrometer described the above, by introducing argon gas to the center or the plasma torch through the second gas flow controller besides the nebulizer gas, the structure (plasma temperature of electron density) of the plasma changes. The generation of molecular ions becomes more difficult. As a result, the blank level in such elements, Fe or K, that are interfered by the molecular ions is decreased and the analytical performance is greatly improved.

DESCRIPTION OF THE PREFERRED EMBODIMENTS

An embodiment of the invention will be described with reference to FIG. 1 as follows.

Figure 1:
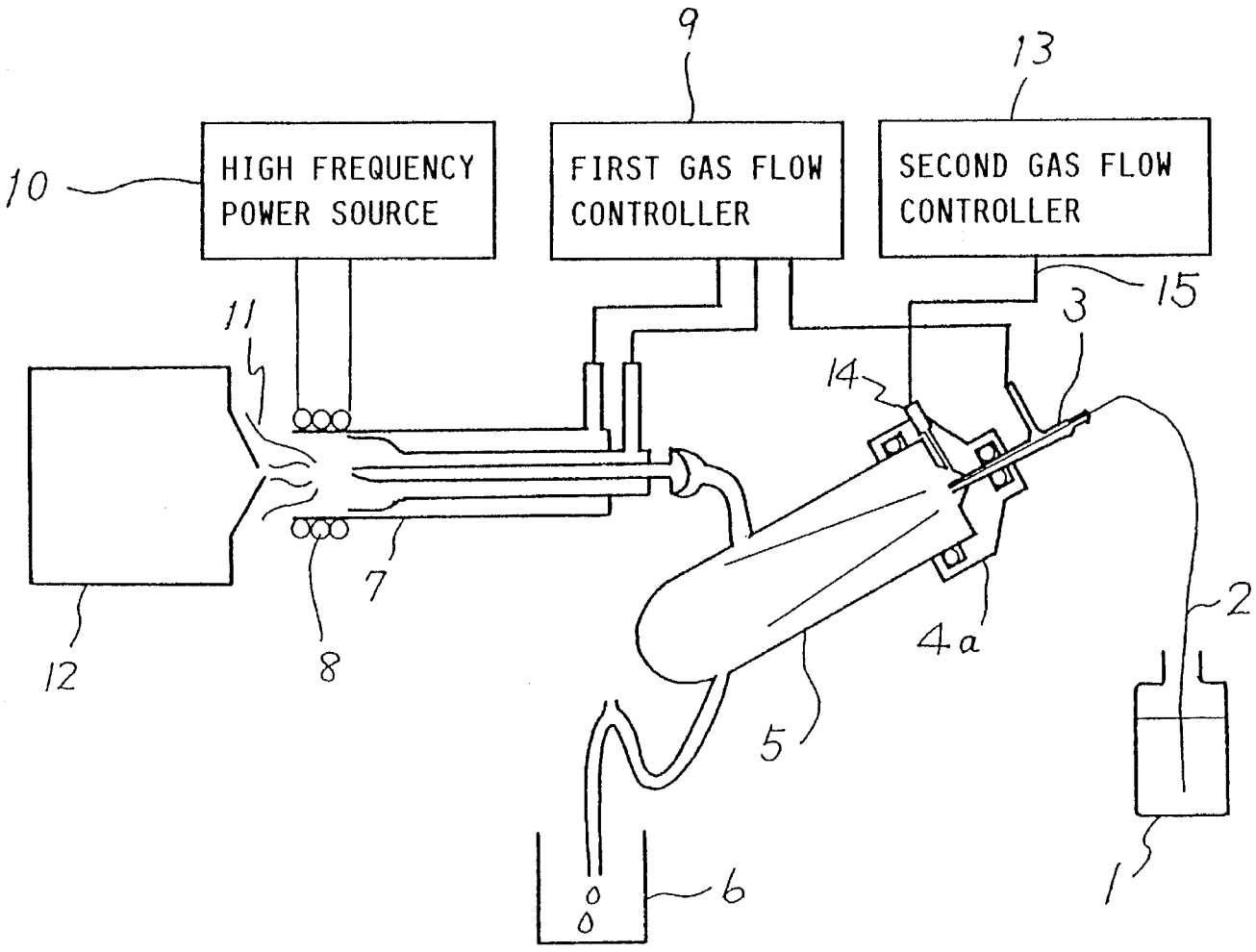
FIG. 1 is a block diagram of an embodiment of the present invention.
Figure 2:
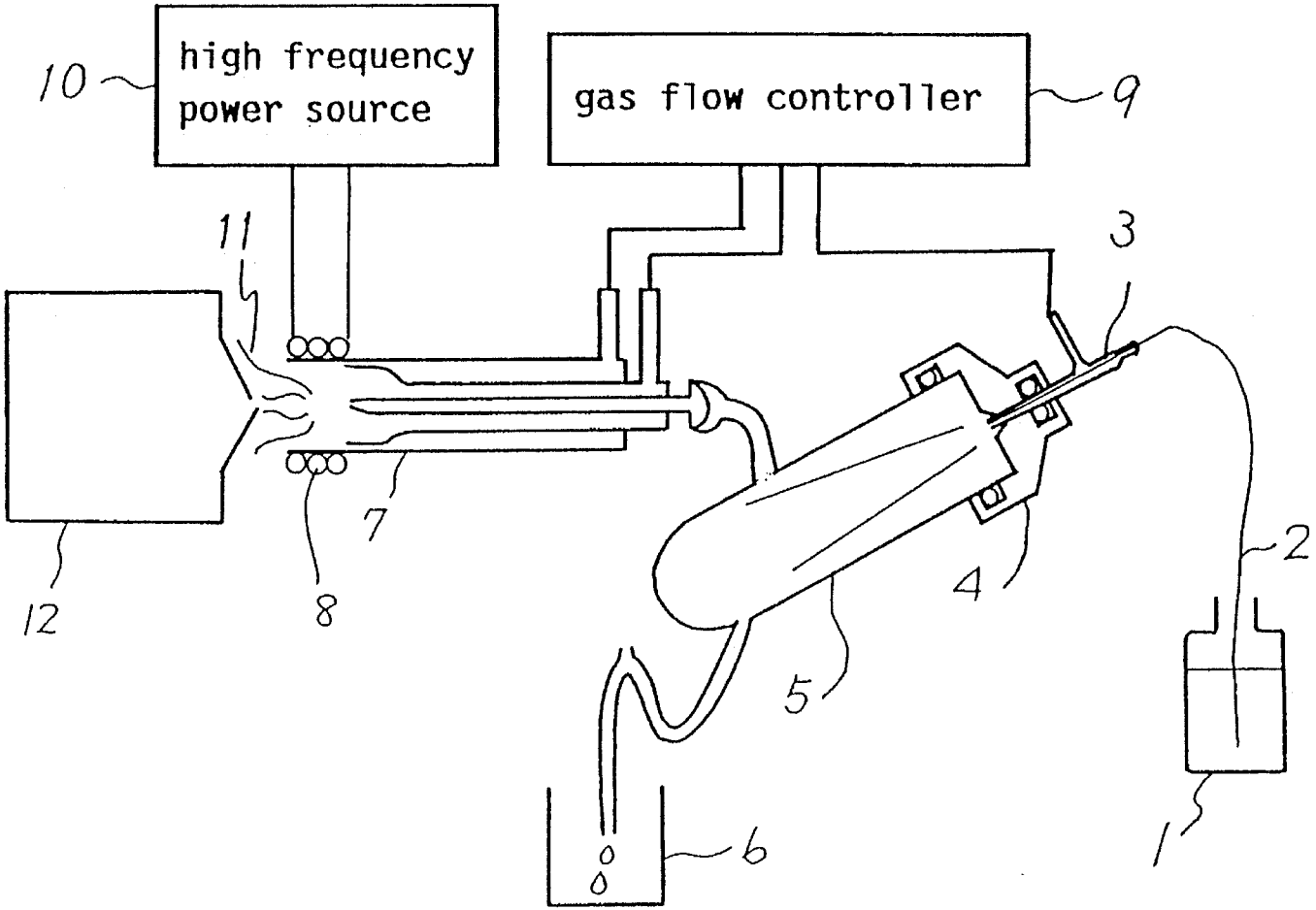
PRIOR ART FIG. 2
FIG. 2 is a block diagram of a prior art ICP-MS, showing particularly the elements for the sample solution introduction.

In FIG. 1, a sample solution 1, a capillary tube 2, a nebulizer 3, a spray chamber 5, a drain 6, a plasma torch 7, a work coil 8, a first gas flow controller 9, a high frequency power source 10, a plasma 11 and a mass detector 12 are the same as the prior art described with reference to FIG. 2. Numeral 4*a* is a modified adapter, numeral 13 is a second gas flow controller, numeral 14 is a coupling and numeral 15 is a tube.

The adapter 4*a* is connected with the spray chamber 5 and the nebulizer 3, and furthermore is connected with the coupling 14 at the side of adapter 4*a*. A gas whose flow is controlled by the second gas flow controller 13 (hereinafter, the gas is called the spray chamber gas) flows to the spray chamber 5 through the tube 15, the coupling 14 and the adapter 4*a*. That is to say, a portion of the sample solution 1 together with nebulizer gas and the spray chamber gas are introduced into the center tube of the plasma torch 7 through the spray chamber 5. Acid such as nitric acid or fluoric acid, or an organic solvent such as xylene or MIBK is used as a solvent in the sample solution 1. Accordingly, for the materials of the adapter 4*a*, the coupling 14 and tube 15, a fluorine-containing polymer such as PTFE etc., which has resistance against acids and organic acids is used.

The flow of the gas controlled suitably by the first gas flow controller 9 and the second gas flow controller 13 are controlled as follows. The flow of the spray chamber gas is controlled to be between 0 and 11 cc/min, the flow of the nebulizer gas is controlled to be 0–21 cc/min, the flow of the plasma gas is controlled to be 0–201 cc/min and the assist gas is controlled to be 0–21 cc/min. The first gas flow controller 9 and the second gas flow controller 13 can also be fabricated into a single module, in which case, needless to say, the present invention is also effective.

Figure 3:
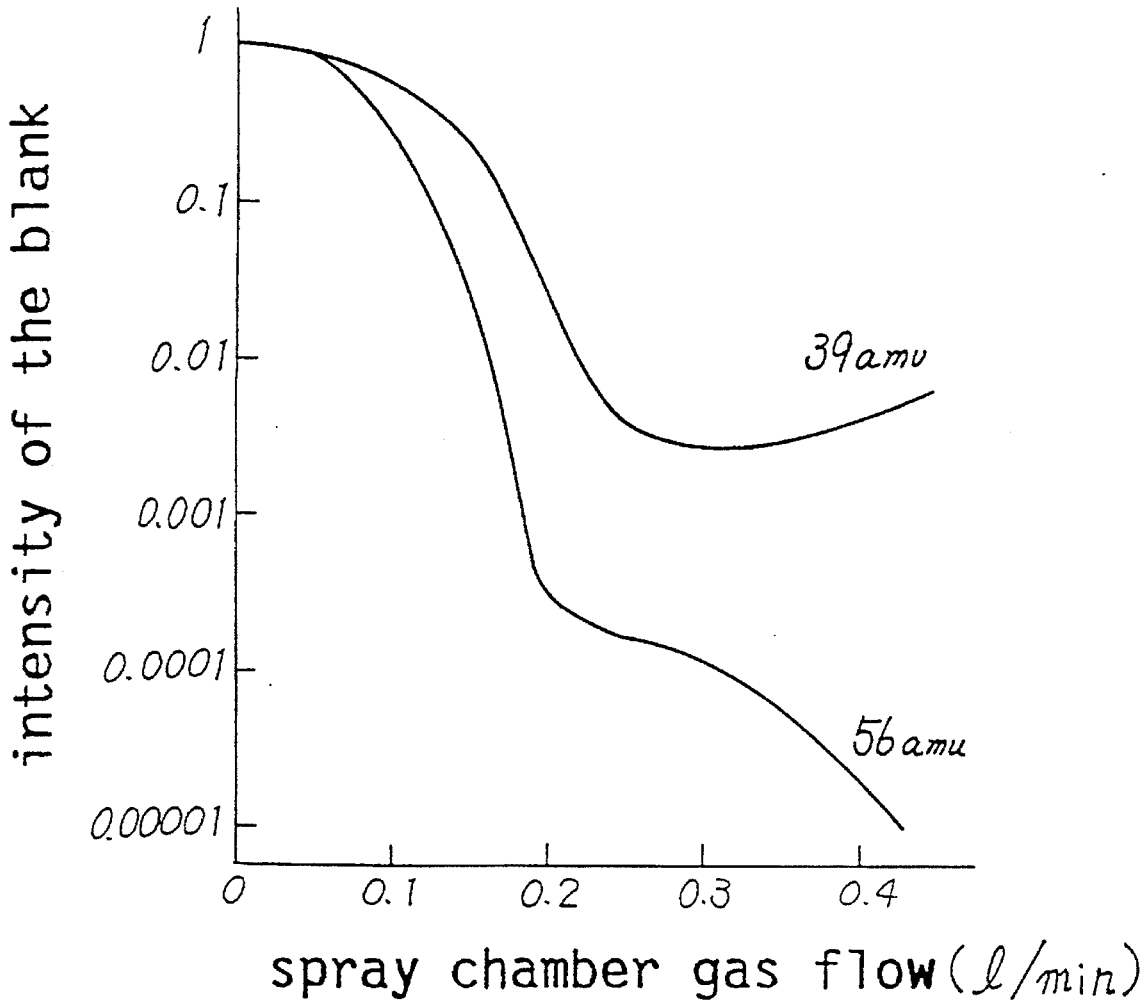
FIG. 3 is a diagram showing graphical relations of changes in molecular ions that interfere with Fe and K as a function of Argon spray gas flow rate changes.

Next, with reference to FIG. 3, when the phenomena of the interference of the molecular ions, which is observed when argon gas as the spray chamber gas is introduced into the spray chamber 5, will be explained. FIG. 3 shows the change of the intensity of the 56 amu (ArO ion) and 39 amu (ArH ion) in a blank liquid, in relation to the change in the flow rate of the spray chamber gas. According to FIG. 3, it is understood that the intensities of ArO ions which interfere with Fe and ArH ions which interfere with K are respectively lowered down to values less than one thousandth and one hundredth, respectively, of the values existing in prior art apparatus, by introducing the spray chamber gas. This occurs because the plasma structure (plasma temperature or electron density, etc.) changes and then generation of molecular ions becomes more difficult, if Argon gas is introduced into the spray chamber. That is to say, by introducing argon gas as spray chamber gas into the spray chamber 5, the plasma temperature becomes lower. Under this temperature condition, argon gas becomes harder to be ionized. Sample solution atoms are less affected compared with argon since the ionization temperature of sample atoms is lower than that of argon. Accordingly, argon (Ar) becomes harder to react. That is, it becomes more difficult to generate molecular ions of argon.

As a result of this invention, the measurements of Fe and K can respectively be done down to levels less than about 0.01 ppb and about 0.1 ppb. FIG. 3 shows that this occurs for spray chamber gas flows in the vicinity if 0.2 l/min. In the prior art, Fe and K can be measured at not less than about one ppb and ten ppb, respectively. This invention, compared to the prior art, is thus very advanced. Moreover, in addition to the case of ArO ions and ArH ions, ArC ions (interfere against 52Cr) or ArNH ions (interfere against 55Mn) etc. can also be reduced, if argon gas is introduced as the spray chamber gas.

Here, an additional important fact should be specified as follows. That is, use of argon for the spray chamber gas can not only gain the above-mentioned effect that the amount of molecular ions can be lowered, but also avoid the drawback that other molecular ions are generated by the introduction of the spray chamber gas. For example, if nitride gas is introduced as the nebulizer gas or the spray chamber gas, ClN ions which interfere with Ti, V and Cr, could be generated.

As the invention is disclosed above, the gas flow which is introduced at the center of the plasma torch is controlled by the first gas flow controller which controls the rate of gas flow through the nebulizer and the second gas flow controller. And argon is used as the gas controlled by the second gas flow controller. Therefore, the amount of molecular ions can be reduced and analytical performance in measurement of such elements as Fe, K etc. that is interfered with by the molecular ions, can be greatly improved.

This application relates to subject matter disclosed in Japanese Application number 4-242084, filed on Sep. 10, 1992, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An inductively coupled mass spectrometer for detecting impurities present in infinitesimal concentrations in a sample, said spectrometer comprising:

a nebulizer connected to receive a solution of the sample;

a first gas flow controller connected to deliver a gas at a controlled flow rate to said nebulizer for causing said nebulizer to produce a spray in the form of a mist composed of droplets of the sample solution;

a spray chamber disposed for receiving the spray and classifying the droplets in the spray;

a plasma torch composed of three tubes, including an outer tube, a middle tube nested within said outer tube and a center tube nested within said middle tube, said center tube being connected to said spray chamber to receive said classified spray droplets from said spray chamber, and said outer tube and middle tube being connected to each receive a gas, said torch being operative for conducting a stream composed of the sample solution received by said center tube and the gas received by each of said middle tube and said outer tube;

a high frequency power source and a work coil coupled to said plasma torch for supplying energy to generate and maintain a plasma which ionizes the sample solution in the stream;

a mass detector disposed for receiving the ionized sample solution from said plasma torch and operative for detecting impurities in the ionized sample solution; and a second gas introducing means coupled to said center tube of said plasma torch for delivering a flow of argon gas into said plasma torch independently of the gas delivered to said nebulizer by said first flow controller.

2. A spectrometer as defined in claim 1, wherein said second gas introducing means comprise a second gas flow controller.

3. A spectrometer as defined in claim 1, wherein said nebulizer has an outlet end which faces into said spray chamber and comprises an outlet nozzle in which the spray is formed, and said second gas introducing means delivers the argon gas to said spray chamber at a location adjacent said nozzle.

4. A spectrometer as defined in claim 1, wherein said mass detector performs mass separation of the ionized sample solution.

5. An inductively coupled mass spectrometer for detecting impurities present in infinitesimal concentrations in a sample, said spectrometer comprising:

a nebulizer connected to receive a solution of the sample;

a first gas flow controller connected to deliver a gas at a controlled flow rate to said nebulizer for causing said nebulizer to produce a spray in the form of a mist composed of droplets of the sample solution;.

a spray chamber disposed for receiving the spray and classifying the droplets in the spray;

a plasma torch composed of three tubes, including an outer tube, a middle tube nested within said outer tube and a center tube nested within said middle tube, said center tube being connected to said spray chamber to receive said classified spray droplets from said spray chamber, and said outer tube and middle tube being connected to each receive a gas, said torch being operative for conducting a stream composed of the sample solution received by said center tube and the gas received by each of said middle tube and said outer tube a high frequency power source and a work coil coupled to said plasma torch for supplying energy to generate and maintain a plasma which ionizes the sample solution in the stream;.

a mass detector disposed for receiving the ionized sample solution from said plasma torch and operative for detecting impurities in the ionized sample solution; and a second gas introducing means coupled to said center tube of said plasma torch for delivering a flow of argon gas into said plasma torch, wherein said second gas introducing means introduce the argon gas into said spray chamber along a path which is external to said nebulizer.

6. A spectrometer as defined in claim 5, wherein said second gas introducing means comprise a second gas flow controller.

7. A spectrometer as defined in claim 5, wherein said nebulizer has an outlet end which faces into said spray chamber and comprises an outlet nozzle in which the spray is formed, and said second gas introducing means delivers the argon gas to said spray chamber at a location adjacent said nozzle.

* * * * *